US011168446B2

(12) United States Patent
Duffner et al.

(10) Patent No.: US 11,168,446 B2
(45) Date of Patent: Nov. 9, 2021

(54) RAIL FASTENING APPARATUS

(71) Applicants: voestalpine Railway Systems Nortrak LLC, Cheyenne, WY (US); voestalpine VAE GmbH, Vienna (AT)

(72) Inventors: Brent Duffner, Pinson, AL (US); Gary Click, Birmingham, AL (US); Bradley Smith, Vestavia, AL (US); Derek Cameron, Birmingham, AL (US)

(73) Assignees: voestalpine Railway Systems Nortrak LLC, Cheyenne, WY (US); voestalpine VAE GmbH, Vienna (AT)

( * ) Notice: Subject to any disclaimer, the term of this patent is extended or adjusted under 35 U.S.C. 154(b) by 75 days.

(21) Appl. No.: 16/489,325

(22) PCT Filed: Dec. 5, 2017

(86) PCT No.: PCT/IB2017/057626
§ 371 (c)(1),
(2) Date: Aug. 27, 2019

(87) PCT Pub. No.: WO2018/158624
PCT Pub. Date: Sep. 7, 2018

(65) Prior Publication Data

US 2020/0063376 A1 Feb. 27, 2020

(30) Foreign Application Priority Data

Feb. 28, 2017 (CA) ..... 2959254

(51) Int. Cl.
*E01B 9/44* (2006.01)
*E01B 5/18* (2006.01)
(Continued)

(52) U.S. Cl.
CPC ..... *E01B 9/44* (2013.01); *E01B 5/18* (2013.01); *E01B 9/303* (2013.01); *E01B 9/483* (2013.01); *E01B 9/52* (2013.01)

(58) Field of Classification Search
CPC ... E01B 9/303; E01B 9/44; E01B 9/46; E01B 9/48; E01B 9/483; E01B 9/486;
(Continued)

(56) References Cited

U.S. PATENT DOCUMENTS 1,995,020 A * 3/1935 Woodings ..... E01B 9/486 238/304
2,118,100 A * 5/1938 Myer ..... E01B 9/486 238/349
(Continued)

FOREIGN PATENT DOCUMENTS

DE 3207105 A1 * 9/1983 ..... E01B 9/483
GB 1271186 4/1972

OTHER PUBLICATIONS

International Search Report and Written Opinion for PCT Application No. PCT/IB2017/057626 dated Feb. 23, 2018, pp. 7.
(Continued)

*Primary Examiner* — Zachary L Kuhfuss
(74) *Attorney, Agent, or Firm* — Lowe Graham Jones PLLC

(57) ABSTRACT

An elongated rail fastener apparatus for use near an obstacle such as a guard rail, or other location where space is restricted. The fastener preferably extends past the obstacle and is provided with a shoulder having at least one elevated notch, positioned to allow installation of the clip with a vertical and lateral movement, and without the application of a large force perpendicular to the rail. A U-shaped embodiment of the fastener is also described.

3 Claims, 3 Drawing Sheets

(51) Int. Cl.
*E01B 9/30* (2006.01)
*E01B 9/48* (2006.01)
*E01B 9/52* (2006.01)

(58) Field of Classification Search
CPC ..... E01B 9/54; E01B 9/58; E01B 7/22; E01B 9/50; E01B 9/52
See application file for complete search history.

(56) References Cited

U.S. PATENT DOCUMENTS 2,135,954 A 11/1938 Whisler
4,373,667 A * 2/1983 Duchemin ..... E01B 9/48 238/349
4,569,478 A 2/1986 Bryan

OTHER PUBLICATIONS

Michael Popke, Railroads seek longer-lasting special trackwork components, suppliers say, Rail News: MOW, May 2017. https://www.progressiverailroading.com/mow/article/Railroads-seek-longer-lasting-special-trackwork-components-suppliers-say--51536.

* cited by examiner

RAIL FASTENING APPARATUS

FIELD OF THE INVENTION

This invention relates to fastening apparatus for railway tracks. In particular, this invention relates to a fastening apparatus including an elastic fastener and a shoulder to hold down a rail in an area where guard rails or other obstructions around the rail interfere with access to the rail and fastener.

BACKGROUND OF THE INVENTION

Elastic fasteners are well known for use in holding down a rail in a railway track, preventing it from moving when a train passes over the tracks. They are typically used to fasten a rail to a tie plate or to a concrete tie. They provide a resilient restraint under applied loads when trains pass over the rails. They also provide some holding force under longitudinal loads created when the rails and ties or tie plates expand and contract differently under temperature fluctuations. Some well-known elastic fasteners include the e-clip, SD clip and Fastclip™, all designed by Pandrol Track Systems, and the flat spring clip designed by Schwihag AG. Other elastic fastener configurations are shown in U.S. Pat. Nos. 6,702,192, 6,431,463 and 6,325,300.

Many elastic fasteners are installed with brute force: a sledge hammer is used to force the fastener on to the correct portion of the rail flange. However, the configuration of the trackwork in areas such as switches or turnouts can complicate the process of installing the required fasteners, primarily by limiting the amount of space available to either accommodate the elastic fastener itself, or to access the area where the fastener is to be installed. One example is in the area of a guard rail, which is used to ensure that the wheels of a passing train travel where they are intended to go. As shown in FIG. 1, a typical guard rail assembly 2 is positioned on one side of a running rail 4. On the field side of the running rail 4 (the non-guard side), there are no interfering components and any elastic fastener 6 may be easily installed and used. However, on the gauge side (guard side) of the rail 4, a side chair 8 is provided to house a guard bar 9, which substantially restricts the space available on that side of the rail 4. This arrangement can make it very difficult to access the place at which the elastic fastener 6*a* is to be installed. In addition, the lack of overall space can make it very difficult to properly apply a driving force, or indeed any other type of contact, to the fastener to push it into place on the rail flange.

One earlier solution to the lack of space between the rail and the guard rail is to provide a single clip that holds down the bases of both the running rail and the guard rail, as in U.S. Pat. Nos. 4,844,337 and 8,033,480 and Korean Patent Pub. No. 100834909. However, it is clear that this configuration still requires that the clip be installed by using a driving force in a very narrow space, not much larger than the 2 inches described as separating the heads of the running rail and the guard rail.

Another solution has been to install a regular elastic fastener on each side of the running rail, before installing the guard rail, as shown in Korean Patent Pub. No. 100776203. However, this approach would appear to necessitate removal of the entire guard rail assembly if the fastener holding down the running rail must be replaced or repaired.

U.S. Pat. No. 7,874,527 discloses several rail fastener embodiments. All are relatively elongated, with a toe portion near the rail flange and a heel portion resting in a notch on the supporting tie plate. The central portion of the fastener is held down with a slide chair plate or with a retaining member. To install the fastener, a driving force is applied along the fastener axis, perpendicular to the rail axis, to force the heel out of the notch and into a second notch closer to the rail. A ramp is provided to allow the toe end of the fastener to slide up and on to the flange of the rail. Alternatively, the force may be applied to push the heel end of the fastener over a button or other impediment. In all cases, a strong driving force must be applied to bring the fastener out of its resting position in order to install it securely. Further, the force is applied to a relatively small area of the fastener, conceivably making it easier to miss the intended target when applying the driving force, and damaging the surrounding components. Finally, the fastener appears to require an upturned tab portion so the fastener can be levered out of the engaged position, but the sharp end may be a safety hazard for users, while removal of the fastener would be extremely difficult if the tab portion broke off.

U.S. Pat. Nos. 3,314,605 and 3,515,347 similarly disclose relatively elongated fasteners, configured as spring plates. A toe end of the plate rests on the rail, while the heel end is retained within a support. A central cross-piece embedded in the supporting tie holds the plate down. To install the fastener, it is necessary to thread the fastener on the rail flange, through the cross-piece and then lift it up onto a surface provided by the support at the heel end of the spring plate. While this installation method avoids the necessity of providing a driving force along the plate, the relative complexity of the system, in requiring that the spring plates be passed through a small opening in the central cross-piece, may slow down the process of installation and may make maintenance difficult. In addition, the shape of the spring plate, being relatively thin, may be more susceptible to deformation, particularly during the lifting part of the installation process, than a thicker rod or bar configuration.

The flat spring clip of Schwihag likewise avoids the need for a driving force perpendicular to the rail axis. However, the installation process, which is shown in U.S. Pat. No. 7,874,527 as prior art, also comprises the need to carefully thread the fastener through a relatively flat space under the slide plate beside the rail. This arrangement may be even more difficult because the slide plate completely covers the area between the fastener insertion point and the rail flange, so the fastener is installed blind. In addition, a special installation tool is required to manipulate the fastener, once it has been inserted under the slide plate. The U-shaped spring clip further requires that each leg of the clip be separately levered into an appropriate location.

It is therefore an object of this invention to provide an elastic rail fastener for a guard rail that overcomes some or all of the foregoing deficiencies.

It is a further object of the invention to provide an elastic rail fastener that is simple to install and remove from the area of a guard rail, and is not subject to causing injury or poor installation due to the nearby presence of other objects.

These and other objects of the invention will be better understood by reference to the detailed description of the preferred embodiment which follows. Note that the objects referred to above are statements of what motivated the invention rather than promises. Not all of the objects are necessarily met by all embodiments of the invention described below or by the invention defined by each of the claims.

SUMMARY OF THE INVENTION

In one aspect, the invention comprises fastening apparatus for railway rails, specifically in congested areas of the track, such as switches or turnouts, which may include components very close to the rail being restrained. The apparatus is configured to allow access to the clip, even in areas where components such as rail chairs would complicate installation of the clip. The apparatus includes a fastener or clip, which is relatively elongated, and supported on a shoulder and retainer member positioned to accommodate that elongated length.

The apparatus is installed using a vertical lifting force and a lateral movement, to fit the fastener into appropriate position on the shoulder. The need to apply a strong force to drive the fastener towards the rail, as well as the need to find space to apply such a force, are eliminated with the arrangement.

In one aspect, the invention comprises a rail fastening apparatus to restrain a rail flange on a tie plate, comprising a retainer mounted on the tie plate near the rail flange; a shoulder mounted on the tie plate at a distance from the retainer, the shoulder comprising a first notch above an upper surface of the tie plate; and a resilient fastener having a body length greater than the distance; wherein the fastener fits through the retainer and on the shoulder such that a toe of the fastener restrains the rail flange. The shoulder may further comprise a second notch between the first notch and the tie plate.

In another aspect, the invention comprises an elongated fastener having a U-shape, comprising a pair of elongated leg members separated by a base member.

The foregoing may cover only some of the aspects of the invention. Other aspects of the invention may be appreciated by reference to the following description of at least one preferred mode for carrying out the invention in terms of one or more examples. The following mode(s) for carrying out the invention is not a definition of the invention itself, but is only an example that embodies the inventive features of the invention.

BRIEF DESCRIPTION OF THE DRAWINGS

At least one mode for carrying out the invention in terms of one or more examples will be described by reference to the drawings thereof in which.

DETAILED DESCRIPTION OF AT LEAST ONE MODE FOR CARRYING OUT THE INVENTION IN TERMS OF EXAMPLE(S)

Figure 1:
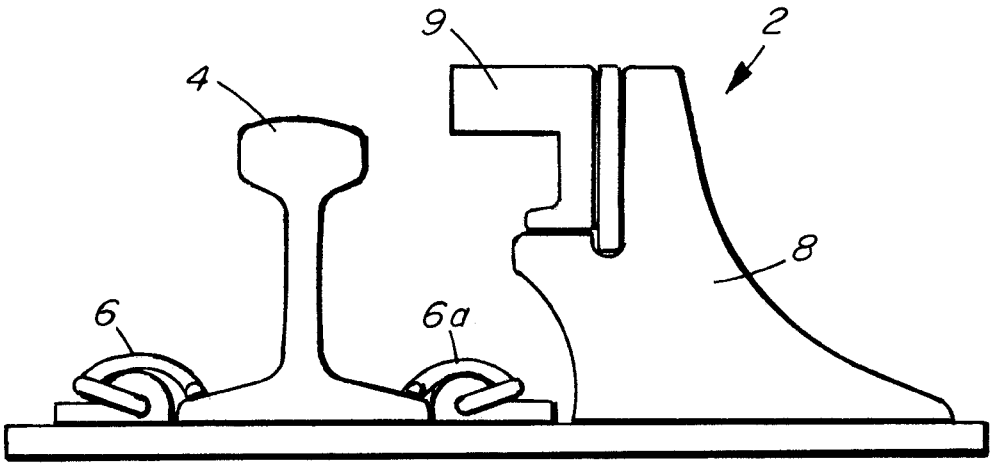
FIG. 1 PRIOR ART
FIG. 1 is an end view of a typical rail assembly in the area of a guard rail.
Figure 2:
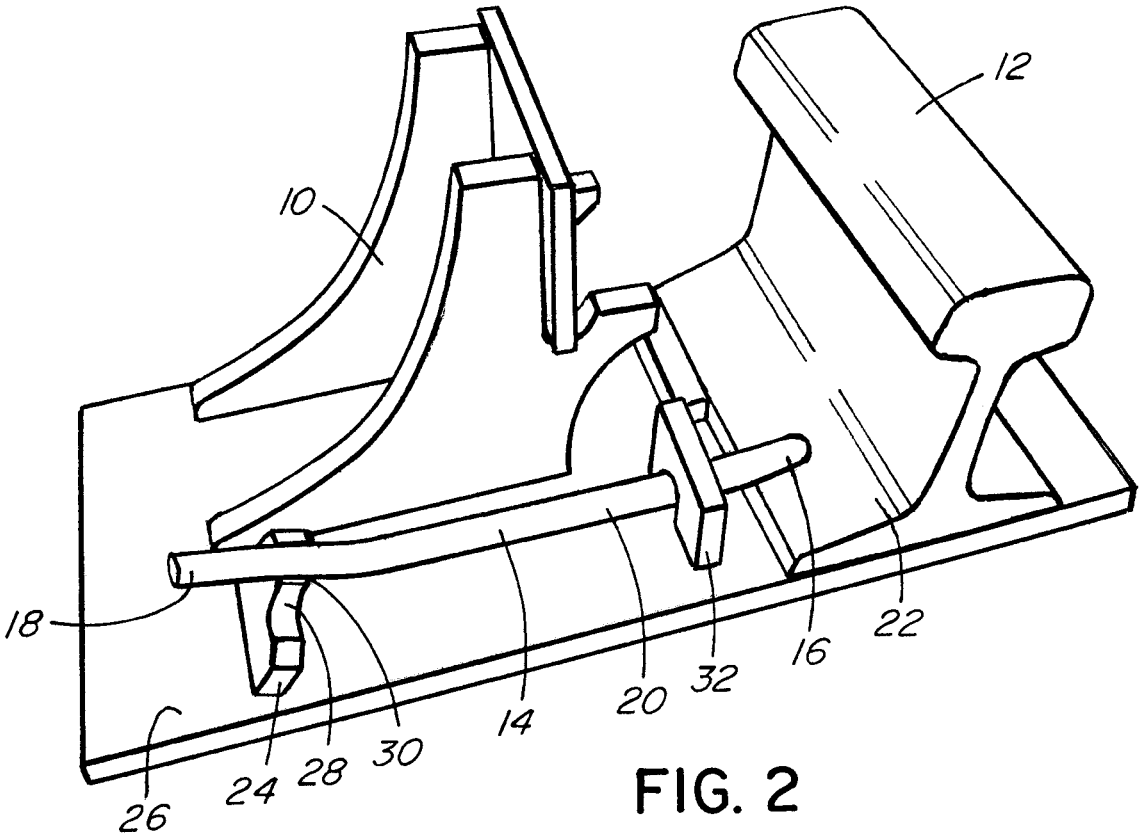
FIG. 2 is a perspective view of the fastener apparatus of the invention.

An embodiment of the rail fastening apparatus of the invention is shown in FIG. 2, in place around an obstacle, such as rail chair 10, near a running rail 12. The fastening apparatus comprises fastener 14, being a relatively elongated bar or rod shaped piece of a suitably resilient material, with a toe end 16 separated from a heel end 18 by a central portion 20. The toe end 16 is preferably slightly tapered or angled, allowing it to slide more easily on to the flange 22 of rail 12. Heel end 18 may be relatively straight or may have a bend or curl. It is preferred that any bend not be directed significantly upwards once the fastener 14 is installed, as having an upward-pointing piece may pose a danger to workers or passersby.

A shoulder 24 is provided on tie plate 26, spaced from the rail 12. The exact separation distance will depend on the length of the fastener 14, but the shoulder 24 will be located near the heel end 18 of the fastener 14, when it is in place on the rail flange 22. Shoulder 24 is preferably provided with a pair of notches 28, 30, of which one is slightly more elevated than the other. Alternatively, shoulder 24 may be provided with a single notch 30, which is elevated above the surface of tie plate 26.

A retainer 32 may be provided on tie plate 26 between rail 12 and shoulder 24. In the embodiment shown, the retainer 32 is an inverted U-shape, but it will be understood that the retainer may be provided with an open side, which may simplify installation of the fastener 14.

The length of fastener 14 is selected such that the shoulder 24 can be located towards the rear of the rail chair 10, or otherwise away from any other components that might otherwise physically prevent access to the shoulder 24. This facilitates installation of the fastener 14. It will be understood that the location(s) of the shoulder 24 may be selected to optimize the ability to restrain the rail. For example, the fastener 14 may be placed on either or both sides of a rail chair or other obstacle, or may be placed between any two proximate obstacles.

Figure 3:
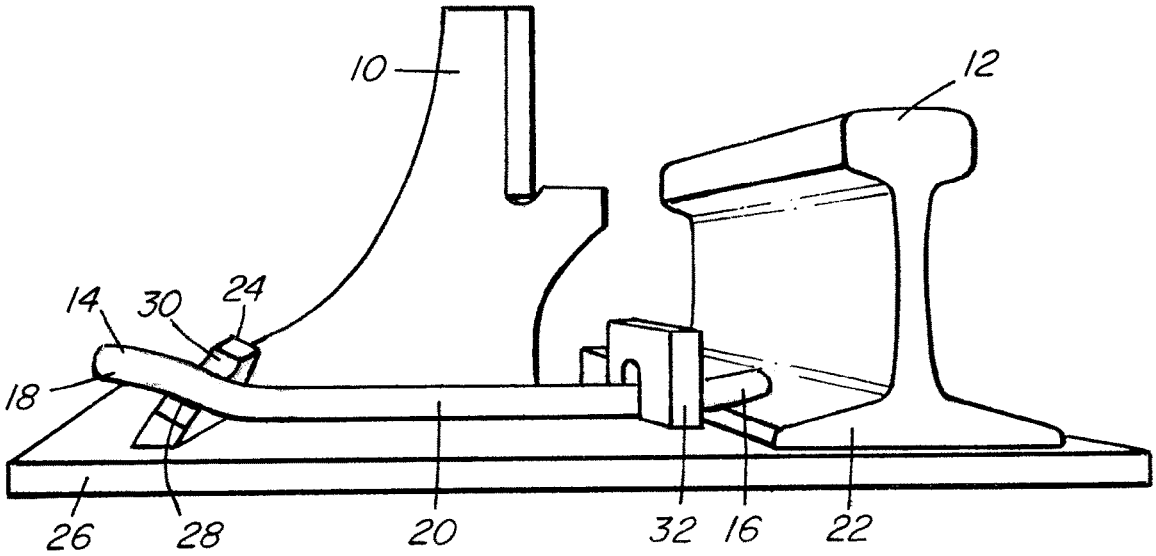
FIG. 3 is a side view of the fastener apparatus in a resting position.
Figure 4:
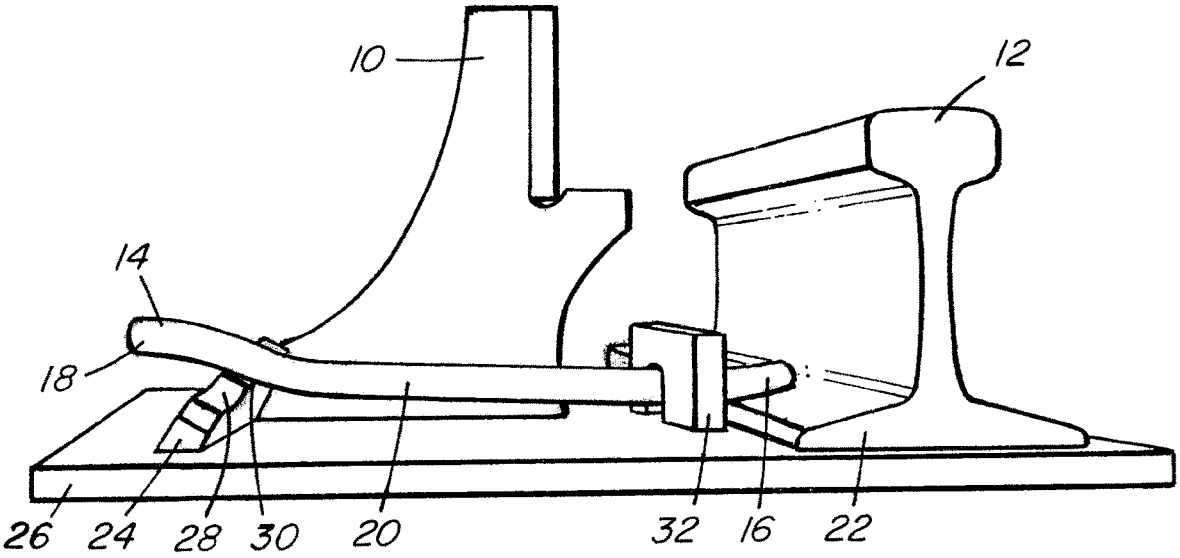
FIG. 4 is a side view of the fastener apparatus in an engaged position.

Referring now to FIGS. 3 and 4, the fastener 14 is installed by inserting it through retainer 32, such that toe end 16 rests on or near rail flange 22. Heel end 18 is placed in a resting position, either on the tie plate 26 or lower shoulder notch 28.

In this resting position, rail 12 may be adjusted as needed. Once it is desired to hold down rail 12, fastener 14 is moved to engage toe end 16 with rail flange 22, if it is not already so engaged, and a suitable levering mechanism is used to move heel end 18 vertically and laterally, so as to engage with shoulder notch 30. In this engaged position, fastener 14 is retained at a downward angle from shoulder 24 through retainer 32, such that toe end 16 applies a downward force to rail flange 22. The fastener 14 is thus exerting a sufficient toe load on rail flange 22 to restrain the rail 12.

The configuration of the rail fastener apparatus has several benefits. As the fastener is installed primarily through a slight vertical lift and a lateral movement, it is unnecessary to apply a driving force perpendicular to the rail axis, or indeed any driving force at all. The ability to apply a force directly to the body of the fastener, rather than on an end, which would usually be a smaller cross-sectional area, also makes it easier to apply the force in the right area. This in turn avoids possible damage that might be caused, for example, by driving a clip incorrectly and having it unexpectedly spring off the rail flange. In addition, a simple levering tool may be used to install the fastener 14; no specialized tool is required. Finally, the application of a relatively small vertical and lateral force means that less brute strength is required of a person installing the fastener.

The fastener 14 is illustrated as being a bar having a round section. However, it will be understood that other cross-sections, such as square or flat, may also be used.

Figure 5:
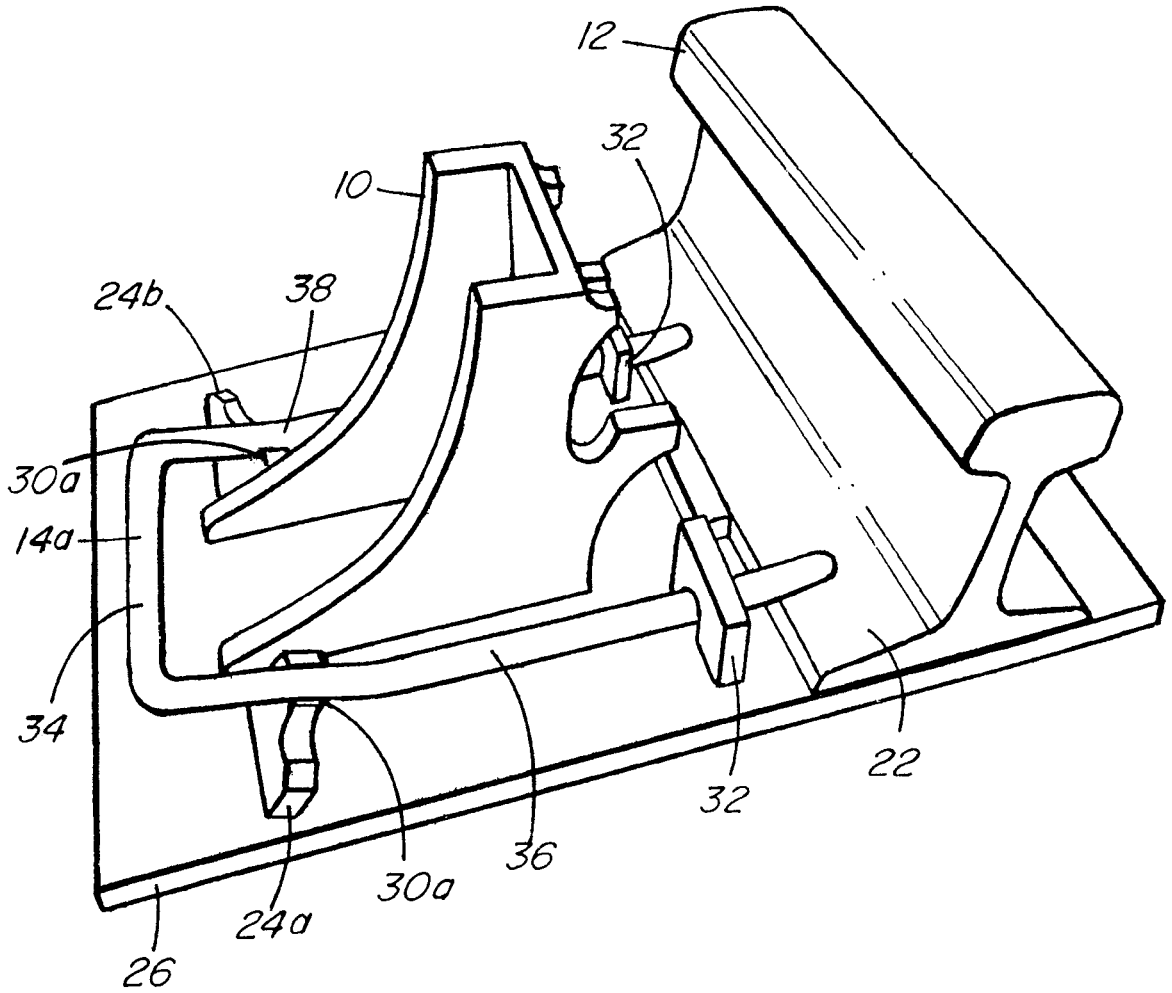
FIG. 5 is a perspective view of an alternative embodiment of the fastener apparatus of the invention.

In another embodiment, best shown in FIG. 5, the fastener **14*a* may be U-shaped, comprising a base 34 connecting a first leg 36 and a second leg 38, where the first and second legs 36, 38 are essentially similar in configuration to fastener 14 described earlier. This U-shaped configuration allows a fastener 14*a* to be easily installed on both sides of an obstacle such as rail chair 10. In this embodiment, separate shoulders 24***a*, 24*b* may be provided for the each leg 36, 38, such that the fastener 14*a* is installed by then lifting each leg 36, 38 onto a notch 30*a* in its respective shoulder 24*a*, 24*b*. Alternatively, a single shoulder (not shown) may be provided along the base, such that the fastener 14*a* may be more easily installed by lifting only the base 34 into the notch on that shoulder. Such embodiments may be selected as appropriate, having regard to the size of the relevant obstacle and the required toe load for a given application, while providing resistance to longitudinal forces and allowing the proper degree of resilience in the rail.

In the foregoing description, exemplary modes for carrying out the invention in terms of examples have been described. However, the scope of the claims should not be limited by those examples, but should be given the broadest interpretation consistent with the description as a whole. The specification and drawings are, accordingly, to be regarded in an illustrative rather than a restrictive sense.

The invention claimed is:

1. A rail fastening apparatus to restrain a rail flange on a tie plate, comprising:

a first retainer mounted on the tie plate near the rail flange;

a first shoulder mounted on the tie plate at a distance from the first retainer, the first shoulder comprising a first notch in a side surface of the first shoulder, above an upper surface of the tie plate; and an elongated resilient fastener having a heel end and a toe end, and a body length between the heel end and the toe end that is greater than the distance;

wherein the elongated resilient fastener fits through the retainer and the heel end fits in the first notch on the first shoulder such that the toe end of the elongated resilient fastener restrains the rail flange; and wherein the heel end is inserted into the first notch by lifting the heel end and moving the heal end laterally to the first notch.

2. The rail fastening apparatus of claim 1 wherein the shoulder further comprises:

a second notch between the first notch and the tie plate;

wherein the heel end is lifted and moved laterally to the second notch before being further lifted and moved laterally to the first notch.

3. The rail fastening apparatus of claim 1, further comprising:

a second retainer mounted on the tie plate, spaced from the first retainer;

a second shoulder mounted on the tie plate spaced from the second retainer;

wherein the elongated resilient fastener has a U-shape, comprising first and second elongated leg members separated by a base member; and the first elongated leg member fits through the first retainer and in the notch in the first shoulder and the second elongated leg member fits through the second retainer and in a notch on the second shoulder.

* * * * *